US007678754B2

(12) United States Patent
Fausnight et al.

(10) Patent No.: US 7,678,754 B2
(45) Date of Patent: Mar. 16, 2010

(54) SYSTEM AND METHOD FOR CLEANING AND/OR TREATING SURFACES OF OBJECTS

(75) Inventors: Ronald Logan Fausnight, Spring, TX (US); Marc Frederick Fagelman, The Woodlands, TX (US)

(73) Assignee: Shell Oil Company, Houston, TX (US)

( * ) Notice: Subject to any disclaimer, the term of this patent is extended or adjusted under 35 U.S.C. 154(b) by 1171 days.

(21) Appl. No.: 11/262,636

(22) Filed: Oct. 31, 2005

(65) Prior Publication Data

US 2006/0118139 A1 Jun. 8, 2006

Related U.S. Application Data

(60) Provisional application No. 60/623,986, filed on Nov. 1, 2004.

(51) Int. Cl.
*C11D 1/02* (2006.01)

(52) U.S. Cl. ..... 510/421; 510/427

(58) Field of Classification Search ..... 510/421, 510/427

See application file for complete search history.

(56) References Cited

U.S. PATENT DOCUMENTS

| | | | | |
|---|---|---|---|---|
| 4,368,146 | A | 1/1983 | Aronson et al. | 252/542 |
| 4,591,449 | A | 5/1986 | Goedhart et al. | 252/99 |
| 4,597,886 | A | 7/1986 | Goedhart et al. | 252/95 |
| 5,429,867 | A | 7/1995 | McCarthy et al. | 428/331 |
| 5,733,377 | A * | 3/1998 | Howe | 134/3 |
| 5,759,980 | A | 6/1998 | Russo et al. | 510/241 |
| 5,853,809 | A | 12/1998 | Campbell et al. | 427/407.1 |
| 5,962,388 | A | 10/1999 | Sherry et al. | 510/238 |
| D432,208 | S | 10/2000 | Beaver et al. | D23/225 |
| 6,225,434 | B1 | 5/2001 | Sadvary et al. | 528/29 |
| 6,562,142 | B2 * | 5/2003 | Barger et al. | 134/6 |
| 6,726,779 | B2 * | 4/2004 | Klos et al. | 134/36 |
| 6,846,512 | B2 * | 1/2005 | Rohrbaugh et al. | 427/201 |
| 7,144,177 | B2 * | 12/2006 | Van Buskirk et al. | 401/265 |
| 7,188,786 | B2 * | 3/2007 | Dodd | 239/310 |
| 7,267,728 | B2 * | 9/2007 | Barger et al. | 134/26 |
| 2002/0045010 | A1 | 4/2002 | Rohrbaugh et al. | 427/372.2 |
| 2002/0096199 | A1 * | 7/2002 | Duckett et al. | 134/26 |
| 2002/0102359 | A1 * | 8/2002 | Rohrbaugh et al. | 427/388.4 |
| 2002/0144712 | A1 * | 10/2002 | Barger et al. | 134/6 |
| 2002/0160224 | A1 * | 10/2002 | Barger et al. | 428/689 |
| 2004/0101455 | A1 * | 5/2004 | Klos et al. | 422/264 |
| 2005/0284960 | A1 * | 12/2005 | Arevalo et al. | 239/310 |
| 2009/0108021 | A1 * | 4/2009 | Hansen et al. | 222/1 |

* cited by examiner

*Primary Examiner*—Gregory E Webb

(57) ABSTRACT

A system and method that are capable of cleaning and/or treating a surface of an object, such as the exterior surface of a vehicle. The system and method utilize wash solution formulations and rinse solution formulations including a wash solution composition that contains at least one ethoxylated interpolymer and a rinse solution with at least one layered silicate incorporating an inorganic pholyphosphate peptiser.

12 Claims, 1 Drawing Sheet

SYSTEM AND METHOD FOR CLEANING AND/OR TREATING SURFACES OF OBJECTS

The present application claims the benefit of pending U.S. Provisional Patent Application Ser. No. 60/623,986 filed Nov. 1, 2004, the entire disclosure of which is hereby incorporated by reference.

FIELD OF THE INVENTION

The present invention relates to cleaning and/or treating surfaces of an object, preferably surfaces such as ceramic, steel, plastic, glass and/or painted surfaces including but not limited to the exterior surface of a vehicle.

BACKGROUND OF THE INVENTION

Products for cleaning and treating surfaces are used to clean soil from the surface and to leave the surface with an appealing finish. However, when the water dries from the surface after using these products, watermarks, smears, and spots are left behind. When the water evaporates, it leaves behind mineral deposits. Some cleaning solutions contain chemicals that allow the water to forms beads on the surface of the object, thus creating more spots and watermarks. This has meant that manual devices such as towels or chamois had to be used to remove these water deposits.

In addition to cleaning such surfaces, it is desirable to leave these surfaces with a clean finish that lasts for a reasonable period of time. Even though such surfaces are left with a spot-free finish, when the surfaces are contacted with water, such as rainwater, in the case of surfaces exposed to outside elements, or tap water for interior surfaces, these surfaces quickly lose their spot-free finish due to the same factors that cause spotting, such as dirt, deposits of minerals which were present as dissolved solids in the water, and the like, when the surfaces are originally cleaned.

Though there are a number of waxes and other products in the market for attempting to retain this spot-free finish, these products are designed to hydrophobically modify these surfaces so that rainwater and tap water will bead up on such surfaces. However, it is believed that the beading of water on such surfaces may actually increase the formation of water spots since the beads of water will leave deposits on the surface when they dry. Thus, there is a need to provide a process of cleaning a surface without the appearance of watermarks, even after the treated surface is later contacted with water.

Moreover, there is a need to increase the speed of washing an object such as a vehicle. Standard car wash products as used at home are liquids added to a pail of water that are then applied to a vehicle with a sponge, cloth, or mitt and rinsed with a garden hose. These products require towel drying to avoid water spots on the surfaces of the vehicle. Therefore, a need exists to reduce the complexity of the process to clean or treat the surfaces of objects such as vehicles.

SUMMARY OF THE INVENTION

The present invention relates to systems, formulations, and methods for cleaning and/or treating surfaces, preferably surfaces such as the exterior surface of a vehicle.

This invention reduces or eliminates the need to use a pail and also eliminates the need for any towel drying with most vehicles. The applicator system replaces the pail and the chemistry of the wash formula in combination with the rinse formula eliminates the need to towel dry the vehicle. The wash formula contains hydrophilic polymers that enhance the wetting of the wash solution beyond the performance produced by the detergent components. The rinse formula is substantive to painted and glass surfaces and remains behind as the vehicle is rinsed leaving a thin uniform layer of water that dries with a sheeting action, typically with drying uniform along the edge of the wet surface following the down slope of the surface. This accelerates the drying compared to a non-uniform or beaded water pattern typical of hydrophobic surfaces. However, the major benefit is the lack of areas where water concentrates and dries to form water sports. The result is a clean uniform surface without the need to towel dry. This reduces the time to wash the vehicle to half or less than the typical washing and drying process.

In one embodiment, the invention is directed to a system for cleaning or treating the surface of an object including a first chamber having a wash solution; a second chamber having a rinse solution; a sprayer capable of being connected to each chamber, wherein the sprayer is capable of selectively accessing each chamber and providing water and solution from the chamber; wherein the wash solution comprises an ethoxylated interpolymer having a molecular weight of the polymer matrix in the range of about 1.0-1.5 million; at least one fatty amine oxide; and at least one betaine and/or at least one hydroxysultaine. This system can include rinse solution that comprises a layered silicate incorporating an inorganic pholyphosphate peptiser and optionally a preservative such as sodium hydroxymethylglycinate.

The invention is also directed to a method of cleaning and treating a surface of an object which comprises the steps of (a) applying a washing solution to the surface of the object wherein the cleaning solution comprises: an ethoxylated interpolymer having a molecular weight of the polymer matrix in the range of about 1.0-1.5 million; at least one fatty amine oxide; at least one betaine and/or at least one hydroxysultaine; and water; (b) rinsing the surface of the object to remove with a rinse solution wherein the rinse solution comprises: a layered silicate incorporating an inorganic pholyphosphate peptiser; and (c) allowing the surface of the object to dry without using a towel or similar absorbing device. As discussed here, the preferred embodiment of the object is a vehicle, but those skilled in the art will recognize that a large number objects with an exterior surface can benefit from the teachings of the invention.

The invention is also directed to a formulation for cleaning and treating the surface of an object comprising: an ethoxylated interpolymer having a molecular weight of the polymer matrix in the range of about 1.0-1.5 million; at least one fatty amine oxide; at least one betaine and/or at least one hydroxysultaine; and water. As discussed above, the ethoxylated interpolymer preferably is a polyvinylpyrrolodone (PVP) homopolymer and hydrophilic polyurethane (PUP), most preferably where the PVP/PUR ratio is about 3:1 by weight. In an alternative embodiment, the present invention may include a formulation for treating the surface of an object comprising a layered silicate incorporating an inorganic pholyphosphate peptiser.

The invention also relates to a cleaning kit for cleaning and treating the surface of an object comprising: a first chamber having a wash solution; wherein the wash solution comprises: an ethoxylated interpolymer having a molecular weight of the polymer matrix in the range of about 1.0-1.5 million; at least one fatty amine oxide; and at least one betaine and/or at least one hydroxysultaine; and a second chamber having a rinse solution; wherein the rinse solution comprises a layered silicate incorporating an inorganic pholyphosphate peptiser. The cleaning kit may contain a sprayer. The formulations, systems, and methods may also contain dyes, preservatives, or fragrances.

BRIEF DESCRIPTION OF THE DRAWINGS

While the specification concludes with claims particularly pointing out and distinctly claiming the invention, it is believed that the present invention will be better understood from the following description taken in conjunction with the accompanying drawing in which:

DETAILED DESCRIPTION OF THE PREFERRED EMBODIMENTS

Figure 1:
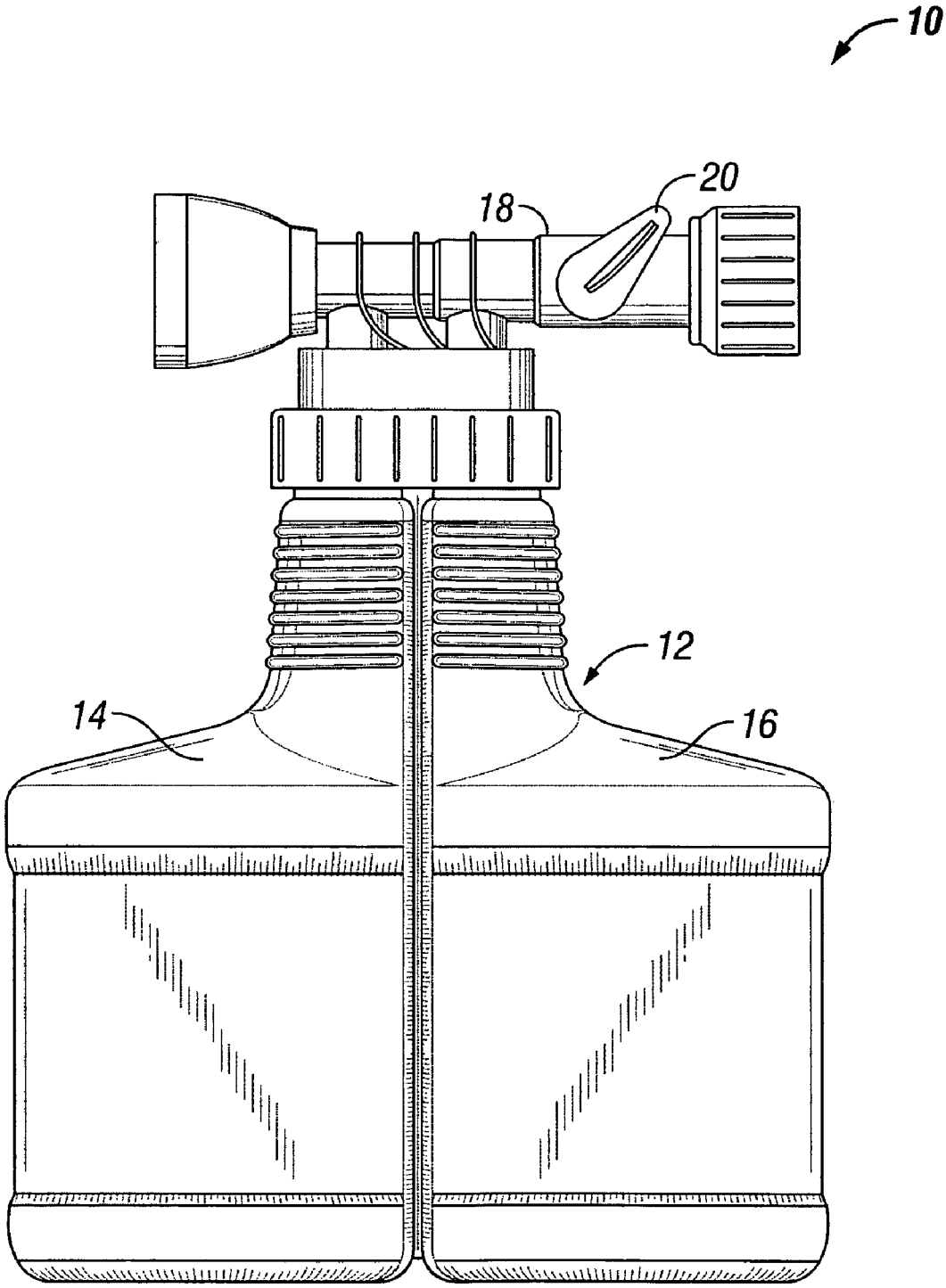
FIG. 1 is a side view of an embodiment of the present invention.

The invention is a car wash formula used in combination with a rinse formula that reduces or eliminates the need to towel dry the object, such as a vehicle. As preliminary matter, the aspects of the invention will be described with reference to a vehicle as an object, but the teachings and scope of the invention are equally applicable to any object with an exterior surface that can benefit from cleaning and treating where the need to manually dry the surface is reduced or eliminated.

The term "surface" includes those surfaces typically found in houses like kitchens and bathrooms, e.g., floors, walls, tiles, windows, sinks, baths, showers, toilets, fixtures and fittings made of different materials like ceramic, porcelain, enamel, and vinyl, no-wax vinyl, linoleum, melamine, glass, any plastics, plastified wood, metal, especially steel and chrome metal, varnished or sealed surfaces and especially, the exterior surfaces of a vehicle, e.g. painted, plastic, metal or glass surfaces and finishing coats.

The wash formula may contain ethoxylated alcohol as a primary surfactant to promote foam and detergency, lauryl dimethylamine oxide as a secondary surfactant to promote foam and to help maintain stability, a cocamidopropyl betaine to improve formula clarity and enhance foam, a water soluble polymer complex of polyvinyl pyrrolodone and hydrophilic urethane. The rinse formula may include a water dispersion of boehmite aluminum oxide nanoparticles with a particle size range from 20-200 angstroms. The particles are orthorhombic dipyramidal crystals formula AlO(OH). Both formulas may contain dye and preservative and optionally a fragrance.

FIG. 1 shows a preferred embodiment of the present invention. The preferred embodiment includes a cleaning and treating system 10 that comprises a dual chambered bottle 12. As shown, a first chamber 14 contains a wash solution and a second chamber 16 contains a rinse solution. The exterior sides of each chamber may include measurement markings or similar indicia that allow for estimation of volume during usage. In a preferred embodiment, the exterior of both chambers 14 and 16 of the bottle 12 have markings that how many fluid ounces of solution is contained in each chamber 14 and 16 respectively. As shown in FIG. 1, the wash solution is contained in the first chamber 14 while the rinse solution is contained in the second chamber 16.

For convenience in this configuration, the two solutions are dispensed with a sprayer 18 attached or otherwise connected to the bottle 12. It is envisioned that each solution could be in a discrete chamber that could be affixed, screwed on, or otherwise fastened in sequence with separate bottles. In the configuration shown in FIG. 1, the system 10 benefits from a dual chambered hose end sprayer 18 screw connected to a dual chambered bottle 12 with a valve capable of delivering water (connected via garden house or similar water source to the sprayer 18 and water mixed with either solution at a preset ratio.

Alternatively, the two solutions may be contained in two separate bottles designed to be attached to the same sprayer assembly 16. The system 10 is preferably purchased as a single unit already containing the wash and rinse solutions with the sprayer 18 attached and forming the package closure. Alternatively, the sprayer 18 could be purchased separately and attached to a two-chambered bottle 12 or the wash and rinse solution could be purchased separately and used to refill the sprayer/bottle system 10.

An advantage of this formula and delivery system 10 is increased speed of washing and convenience to the customer and quality of results. Standard car wash products as used at home are liquids added to a pail of water that are then applied to a vehicle with a sponge, cloth, or mitt and rinsed with a garden hose. These products require towel drying to avoid water spots on the surfaces of the vehicle.

This invention reduces or eliminates the need to use a pail and also reduces or eliminates the need for any towel drying with most vehicles. The applicator system 10 replaces the pail and the chemistry of the wash formula in combination with the rinse formula eliminates the need to towel dry the vehicle. The wash formula contains hydrophilic polymers that enhance the wetting of the wash solution beyond the performance produced by the detergent components. The rinse formula is substantive to painted and glass surfaces and remains behind as the vehicle is rinsed leaving a thin uniform layer of water that dries with a sheeting action, typically with drying uniform along the edge of the wet surface following the down slope of the surface. This accelerates the drying compared to a non-uniform or beaded water pattern typical of hydrophobic surfaces. As previously discussed, a major benefit is the lack of areas where water concentrates and dries to form water sports. The result is a clean, uniform surface without the need to or at least the substantially reduced need to towel dry. This reduces the time to wash the vehicle to half or less than the typical washing and drying process.

In a preferred embodiment, the wash includes some or all of the following ingredients: purified water, at least one fatty amine oxide including but not limited to lauramine oxide, lauramidopropylamide oxide, myristamidopropylamine oxide, cetamine oxide, stearamine oxide, cocamidopropylamine oxide, and similar fatty amine oxides; at least one betaine and/or hydroxysultaine including but not limited to cocamidopropyl betaine, octylamidopropyl betaine, decylamidopropyl betaine, lauramidopropyl betaine, coco betaine, cetyl betaine, lauryl betaine, cocamidopropyl hydroxysultaine, and similar betaines and/or hydroxysultaines; optional glycerine; an ethoxylated interpolymer such as a polyvinylpyrrolodone (PVP) homopolymer and hydrophilic polyurethane (PUP), preferably wherein the PVP/PUR ratio is from a range of about 2:1 to about 4:1 based on a weight average, more preferably about 3:1 by wt. such as the Pecogel H-12™ product and similar polymers wherein the molecular weight average of the polymer matrix is in the range of about 1.0-1.5 million.

In a preferred embodiment, the polyvinylpyrrolodone (PVP) homopolymer and hydrophilic polyurethane (PUP) has a structure of:

(i)

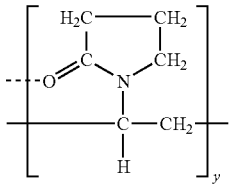

(ii)

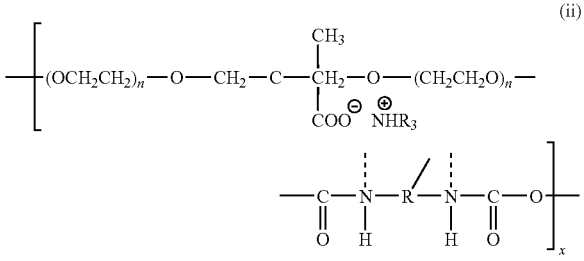

wherein:

R=Ethyl

R'=Aromatic x=Polyurethane Polymer y=PVP x+y=PVP/Polyurethane hydrogel polymer matrix n=a number capable of producing a molecular weight average of the polymer matrix in the range of 1.0 to 1.5 million.

In one preferred embodiment, a number average of y may be in the range of about 5000 to 10,000, a number average of x may be in the range of 150-750, and a number average of n may be in the range of 1 to 20.

In the preferred embodiment, the rinse solution includes a layered silicate incorporating an inorganic pholyphosphate peptiser such as Laponite RDS™ product and optionally a preservative such as sodium hydroxymethylglycinate such as Integra 44™ product. In the preferred embodiment, the hydroxymethyl glycinate is a preservative and does not contribute to product performance except for the benefits of residual akalinity. Other preservatives could be used such as bicyclic oxazolidine that are sometimes marketed under the Nuosept 95™ product name. Water is also included. Finally, optional ingredients include dyes to affect the commercial appeal of the rinse solution, such as Chromatint Blue D35003™ product. Optional nonionic surfactants, alcohol ethoxylates in the range of $C_8$-$C_{20}$, 4-18 moles of ethylene oxide and/or propylene oxide, alkylphenol ethoxylates, octylphenol or nonylphenol, 4-18 moles ethylene oxide or propylene oxide, polyethylene glycol esters, lauric, oleic or stearic acid based, either mono- or di-acids range PEG-4 to PEG 150; optional amides including mono-, di-, or tri-ethanolamide of lauric, stearic, linoleic, coconut and similar fatty acids may be included.

Those skilled in the art will recognize that variations in the ranges and compositions of the chemicals are to be considering within the scope of the invention as disclosed and claimed. The following offers guidance as to the ranges of some of the constituents of the formulation, however, these ranges are but preferred embodiments and should not be construed to limit the amount of any ingredient in the formulation.

The lauramine oxide 30% active solution or similar ingredient may preferably be found in the wash formulation (all weight percent based on the wash formulation) in a range of about 4.0 percent by weight, more preferably about 6.0 percent by weight, most preferably 8.0 percent by weight to about 30.0 percent by weight, more preferably about 24.0 percent by weight, most preferably about 20.0 percent by weight. The cocamidopropylbetaine 30% active solution or similar ingredient may preferably be found in the wash formulation in a range of about 2.0 percent by weight, more preferably 4.0 percent by weight, most preferably 6.0 percent by weight to about 20.0 percent by weight, more preferably about 16.0 percent by weight, most preferably about 14.0 percent by weight. The optional glycerine or similar ingredient may preferably be found in the wash formulation in a range of about 0.0 percent by weight, more preferably 2.0 percent by weight, most preferably 3.0 percent by weight to about 15.0 percent by weight, more preferably about 10.0 percent by weight, most preferably about 8.0 percent by weight. The ethoxylated interpolymer such as a polyvinylpyrrolodone (PVP) homopolymer and hydrophilic polyurethane (PUP), preferably wherein the PVP/PUR ratio such as the Pecogel H-12™ product and similar polymers may preferably be found in the wash formulation in a range of about 0.2 percent by weight, more preferably 0.3 percent by weight, most preferably 0.5 percent by weight to about 5.0 percent by weight, more preferably about 4.0 percent by weight, most preferably about 3.0 percent by weight. The optional preservative such as sodium hydroxymethylglycinate, such as Integra 44™ product or similar ingredient may preferably be found in the wash formulation in a range of about 0.1 percent by weight, more preferably 0.15 percent by weight, most preferably 0.2 to about 1.0 percent by weight, more preferably about 0.8 percent by weight, most preferably about 0.6 percent by weight. The nonionic surfactants or similar ingredient may preferably be found in the wash formulation in a range of about 0.0 percent by weight, more preferably 2.0 percent by weight, most preferably 3.0 percent by weight to about 30.0 percent by weight, more preferably about 20.0 percent by weight, most preferably about 15.1 percent by weight.

In the preferred embodiment, two dyes have been included to distinguish the wash and rinse formulations. Those skilled in the art recognize that these ingredients are optional and that virtually any color of dye may be incorporated or omitted from the invention. In the most preferred embodiment, Liquitint Yellow L81021 ™ product may preferably be found in the wash formulation in a range of about 2 ppm, more preferably 10 ppm, most preferably 20 ppm to about 100 ppm, more preferably about 80 ppm, most preferably about 60 ppm in the wash formulation while Chromatint Blue D35003™ product may preferably be found in the wash formulation in a range of about 10 ppm, more preferably 20 ppm, most preferably 30 ppm to about 500 ppm, more preferably about 300 ppm, most preferably about 200 ppm in the rinse formulation.

The layered silicate incorporating an inorganic pholyphosphate peptiser such as Laponite RDS™ product may preferably be found to be in the rinse formulation (all weight percent based on the rinse formulation) in a range of about 0.1 percent by weight, more preferably 0.2 percent by weight, most preferably 0.5 percent by weight to about 10.0 percent by weight, more preferably about 5.0 percent by weight, most preferably about 3.0 percent by weight. The optional preservative such as sodium hydroxymethylglycinate, such as Integra 44™ product, may preferably be found in the rinse formulation in a range of about 0.1 percent by weight, more preferably 0.15 percent by weight, most preferably 0.2 percent by weight to about 1.0 percent by weight, more preferably about 0.8 percent by weight, most preferably about 0.6 percent by weight.

For optimum performance of each formulation, the formulation is delivered to the surface of the object at a water to formula ratio by volume in the range of about 30:1 to about 500:1, more preferably in the range of about 40:1 to about 350:1.

The sprayer 18 is shown as containing a valve that allows for the selective connection to at least two chambers 14, 16 of the bottle 12. Those skilled in the art recognize that this sprayer could be adapted to connect to a plurality of chambers or connect to one chamber at a time, with the operator switching out chambers during use.

In a preferred embodiment, the sprayer 18 connects to a hose such as a conventional garden hose. This type of spray dispenser is sometime referred to as a Venturi or hose-end system. The sprayer head may include an aperture over which water from the garden hose passes to mix with the cleaning composition from the container. In a preferred embodiment of the present process, the spray dispenser used encompasses a switch or valve system allowing the user to not only spray cleaning composition, but also spray water and/or purified rinse water to rinse the car. In a preferred embodiment, the spray dispenser may also contain a filter or similar device.

The flow selector 20 of the sprayer 18 may be formed to have multiple settings. In a preferred embodiment, the settings, such as "wash" or "rinse" may be labeled on these settings. In a most preferred setting, the labels "Step 1," "Step 2," and so forth may be included. As the procedure outlined below shows, the user may follow the numerical progression of steps when using the kit 10 to complete the cleaning and/or treatment of the surface of the object. It is envisioned that the sprayer 18 may be manually or electrically powered, which can include trigger-operation, pump-operation, or similar devices.

In a preferred method of use, the object such as the vehicle is kept in the shade so that excess water may evaporate at a more controlled rate, thus allowing the solutions to function more efficiently. During preferred use, the user attaches the system 10 to a hose and operates the sprayer 18 to first apply water only to the object by selection "Step 1" or water only on the selector 20. Once the object is thoroughly wet, the operator selects "Step 2" or wash solution on the selector 20 and sprays water and wash solution on the object. In a preferred embodiment, the operator will spray about 2 ounces of car wash soap onto the object. As previously discussed, the side of bottle 12 may contain measure marks to indicate ounces used. The operator then turns the sprayer 18 to an "OFF" position and uses a soft sponge or cloth to wipe away dirt and grime; rinsing the sponge as needed.

Once completed with the washing of the object, the user turns the selector 20 on the sprayer 18 to "Step 3" or similar water only indication and turns the sprayer 18 to an "ON" position. The user rinses away dirt, grime, and suds. Then, the operator turns the sprayer 18 to "Step 4" or similar rinse setting and rinses the object with about 2 ounces of the rinse solution. As previously noted, the outside of the bottle 12 may bear measurement marks to aid in this estimation. The object will air dry for minimal spotting. Though not always necessary, the operator may touch up with soft cloth as needed. However, it is envisioned that the use of towels, chamois, and similar devices will be reduced by the use of the solutions as formulated herein.

The following non-limiting examples, and comparative demonstrations, bring out the more salient features of the invention. All parts are given in terms of weight units except as may otherwise be indicated.

EXAMPLES

The following provides several non-limiting examples of the present invention.

Preparation of the Car Wash Formula:

Purified water was added to a clean tank. A mixer was started in the tank. Lauramine oxide, cocamido propyl betaine and glycerine were added to the tank and the mixture was mixed until the mixture was uniform. Pecogel™ H-12 was added to the mixture and the mixture was mixed until the mixture was uniform. Integra 44™ product and Chromatint Blue™ D35005 were added to the mixture and the mixture was mixed until the mixture was uniform. The mixture had the following components measured by weight percent:

TABLE 1

WASH FORMULA

| Ingredient | Weight % |
|---|---|
| Purified Water | 67.69 |
| Lauramine Oxide 30% | 16.00 |
| Cocamido Propyl Betaine 30% | 10.00 |
| Glycerine 96% | 5.00 |
| Pecogel H-12 ™ product (12%) | 1.00 |
| Integra 44 ™ product 50% | 0.30 |
| Chromatint Blue D35003 ™ product | 0.0121 |

The resulting mixture had a specific gravity of 1.012 and a pH in the range of about 9.0 and about 9.5. The appearance of the resulting mixture was clear blue.

Preparation of the Rinse Formula:

Purified water was added to a clean tank. A mixer was started in the tank. Laponite RDS™ product was added to the tank through a screen or by an eductor the tank. The Laponite RDS™ product was mixed with the purified water until the mixture was clear and uniform. Integra 44™ product and Liquitint™ product yellow dye was added to the mixture and was mixed until the mixture was uniform. The mixture had the following components measured by weight percent:

TABLE 2

RINSE FORMULA

| Ingredient | Weight % |
|---|---|
| Purified Water | 98.70 |
| Laponite RDS ™ product | 1.00 |
| Integra 44 ™ product (50%) | 0.30 |
| Liquitint ™ product Yellow L81021 | 0.0040 |

The resulting mixture had a specific gravity of 1.006 and a pH of in the range of about 9.5 and about 10.0. The appearance of the resulting mixture was clear yellow.

The present invention is not limited to methods that include steps for both cleaning and treating surfaces. For instance, in another non-limiting example, the method of the present invention can comprise only the steps for treating the surface. Any portions or steps of the method described herein may comprise inventions in their own right without regard to the other steps described herein.

While particular embodiments of the subject invention have been described, it will be obvious to those skilled in the art that various changes and modifications of the subject invention can be made without departing from the spirit and scope of the invention. It will be clear to those skilled in the art that various changes and modifications may be made without departing from the scope of the invention and the invention is not to be considered limited to the embodiments and examples that are described in the specification.

What is claimed is:

1. A system for cleaning or treating the surface of an object comprising:

a first chamber having a wash solution;

a second chamber having a rinse solution;

a sprayer capable of being connected to each chamber, wherein the sprayer is capable of selectively accessing each chamber and providing water and solution from the chamber;

wherein the wash solution comprises:

an ethoxylated interpolymer polymer matrix comprising a copolymer of polyvinylpyrrolidone homopolymer and hydrophilic polyurethane and having a molecular weight average in the range of about 1.0-1.5 million;

at least one fatty amine oxide; and at least one betaine and/or at least one hydroxysultaine.

2. The System of claim 1 wherein the rinse solution comprises a layered silicate incorporating an inorganic pholyphosphate peptiser.

3. The System of claim 1 wherein the first chamber and the second chamber are formed as part of a dual chambered bottle that is capable of being connected to the sprayer.

4. The system of claim 1 wherein the ethoxylated interpolymer is a polyvinylpyrrolodone (PVP) homopolymer and hydrophilic polyurethane (PUP) having the structure of:

(i)

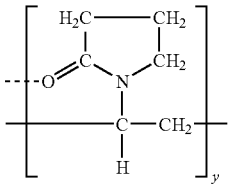

(ii)

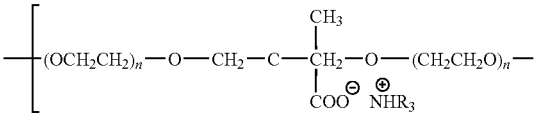

-continued

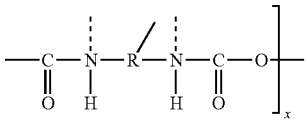

wherein:

R=Ethyl

=Aromatic x=Polyurethane Polymer y=PVP x+y=PVP/Polyurethane hydrogel polymer matrix n=a number capable of producing a molecular weight average of the polymer matrix in the range of 1.0 to 1.5 million.

5. The System of claim 1 wherein the wash solution further comprises glycerine.

6. The formulation of claim 1 wherein the PVP/PUR ratio is from a range of about 2:1 to about 4:1 by weight average.

7. The system of claim 1 wherein the at least one fatty amine oxide is selected from the group consisting of lauramine oxide, lauramidopropylamide oxide, myristamidopropylamine oxide, cetamine oxide, stearamine oxide, and cocamidopropylamine oxide.

8. The system of claim 1 wherein the at least one betaine and/or hydroxysultaine is selected from the group consisting of cocamidopropyl betaine, octylamidopropyl betaine, decylamidopropyl betaine, lauramidopropyl betaine, coco betaine, cetyl betaine, lauryl betaine, and cocamidopropyl hydroxysultaine.

9. The system of claim 1 further comprising glycerine.

10. The system formulation of claim 1 further comprising nonionic surfactants.

11. The system of claim 1, wherein the rinse solution further comprises alcohol ethoxylates in the range of $C_8$-$C_{20}$, 4-18 moles of ethylene oxide and/or propylene oxide, alkylphenol ethoxylates, octylphenol or nonylphenol, 4-18 moles ethylene oxide or propylene oxide, polyethylene glycol esters, lauric, oleic or stearic acid based, either mono- or di-acids range PEG-4 to PEG 150.

12. The system of claim 1, wherein the rinse solution further comprises at least one selected from the group consisting of mono-, di-, or tri-ethanolamide of lauric, stearic, linoleic, coconut and combinations thereof.

* * * * *